United States Patent [19]

Mück et al.

[11] 4,190,694

[45] Feb. 26, 1980

[54] FIBERED SHEET MATERIAL IMITATING NATURAL LEATHER AND METHOD FOR CONTINUOUS MANUFACTURE THEREOF

[75] Inventors: Eduard Mück; Zdenek Hrabal, both of Otrokovice; Ludvik Ambroz, Brno; Josef Horak, Gottwaldov, all of Czechoslovakia

[73] Assignee: Vyzkumny ustav kozedelny, Gottwaldova, Czechoslovakia

[21] Appl. No.: 850,303

[22] Filed: Nov. 10, 1977

Related U.S. Application Data

[63] Continuation-in-part of Ser. No. 718,372, Aug. 27, 1976, abandoned.

[30] Foreign Application Priority Data

Aug. 29, 1975 [CS] Czechoslovakia ..... 5908-75

[51] Int. Cl.[2] ..... B32B 7/02; B32B 27/00

[52] U.S. Cl. ..... 428/212; 428/286; 428/306; 428/423.3; 428/904

[58] Field of Search ..... 428/904, 310, 151, 286, 428/306, 424, 315, 425, 212, 304, 230, 904; 427/245, 378, 385 B

[56] References Cited

U.S. PATENT DOCUMENTS

| | | | |
|---|---|---|---|
| 3,510,344 | 5/1970 | Dunderdale | 428/212 |
| 3,595,732 | 7/1971 | Tingerthal | 428/304 |
| 3,650,880 | 3/1972 | Tieniber | 428/311 |
| 3,652,747 | 3/1972 | Shirota et al. | 428/151 |
| 3,794,548 | 2/1974 | Wirth et al. | 428/311 |
| 3,908,060 | 9/1975 | Okagaki et al. | 428/904 |
| 3,922,402 | 11/1975 | Shimamura et al. | 428/904 |
| 3,958,057 | 3/1976 | Nishimura et al. | 428/904 |
| 3,974,320 | 8/1976 | Gerlach et al. | 428/904 |
| 3,979,532 | 9/1976 | Muck et al. | 428/904 |
| 3,984,607 | 10/1976 | Thoma et al. | 428/904 |
| 4,053,546 | 10/1977 | Yamasaki et al. | 428/904 |
| 4,053,669 | 10/1977 | Kapasi et al. | 428/212 |

FOREIGN PATENT DOCUMENTS

| | | | |
|---|---|---|---|
| 1060766 | 3/1967 | United Kingdom | 428/904 |
| 1132594 | 11/1968 | United Kingdom | 428/904 |

*Primary Examiner*—William J. Van Balen

[57] ABSTRACT

The artificial leather of the invention comprises a fibrous sheet material having on the surface thereof a coating formed of at least two layers of polyurethane elastomer with the elasticity modulus E of the layer of the polyurethane elastomer adjacent to the fibrous sheet being lower than the elasticity modulus $E_2$, $E_3 \ldots E_{p-1}$ of any of the following layer or layers, and at the same time being lower than the elasticity modulus $E_p$ of the finish layer according to the relation $$E_1 < E_2 < E_3 < \ldots < E_{p-1} < E_p,$$

under the condition that all values of the elasticity modulus E are in the range of from 12 to 170 MPa. The method of manufacturing the artificial leather according to the invention is characterized in that the reactive polyurethaneprepolymer, containing free isocyanate -NCO groups, preferably in the range of from 2.2 to 3.2 percent by weight, in admixture with an amine hardening agent of the molar ratio of -NCO groups to $-NH_2$ groups of from 1.0:1.0 to 5.0:1.0, preferably from 1.5 to 1.0 to 3.0:1.0, is coated on the fibrous sheet in an amount of 20 to 600 grams per square meter for individual layers, with the combined thickness of the coated layers being in the range from 50 to 2000 g/m$^2$.

4 Claims, No Drawings

FIBERED SHEET MATERIAL IMITATING NATURAL LEATHER AND METHOD FOR CONTINUOUS MANUFACTURE THEREOF

RELATED APPLICATIONS

This is a continuation-in-part application of the application filed on Aug. 27, 1976 under Ser. No. 718,372, by Eduard Muck, Zdenek Hrabal, Ludvik Ambroz and Josef Horak, under the title "Production of Artificial Leather", now abandoned.

BACKGROUND OF THE INVENTION

This invention relates to a fibered sheet material imitating natural leather, comprising a non-woven fibered mat from a mixture of synthetic fibers and natural fibers, impregnated with aqueous dispersions of elastomers, which have been coated with at least two superposed surface layers; the invention relates also to a continuous manufacture of such a fibered sheet material.

World leather consumption for the production of shoes, cases, upholstered articles and the like is ever increasing; and the sources of natural leathers are not able to keep up with this growth. As a natural result, it is constantly necessary to use more and more artificial sheet materials which have properties analogous to those of natural leathers. These artificial leathers must attain not only the mechanical properties of natural leathers, such as strength, ductility, abrasive resistance, and surface-break resistance under multiple flexing, but they must exhibit also the specific physical and chemical properties of leather materials, such as water vapor permeability and water accumulation and releasing ability.

There have been proposed processes for the manufacture of artificial leathers in which the water vapor permeability and air permeability properties are achieved by subsequently perforating the sheet material with needles (West German Patent No. 958,598) or by coating a non-homogeneous cellular coating layer thereon (French Patents Nos. 1,085,317; 1,134,913, West German Patent No. 934,692).

There have been developed various methods of providing rubberized coatings on woven and knitted fabrics, the greater part of such coatings being vinyl chloride polymers and copolymers, acrylonitrile copolymers with acrylic and methacrylic acid ester, butadiene copolymers with acrylonitrile and styrene, natural rubber latices, as well as mixtures of these polymeric substances. The leather-like materials so obtained have generally low water sorption and low air and water vapor permeability properties, which result in an inconvenient and uncomfortable feeling caused by poor heat and moisture removal when using shoes made of such materials or when using seats covered by these materials.

Microporous artificial leathers have been produced under commercial marks such as Corfam of E. I. DuPont de Nemours and Co., U.S.A., Polcorfam of Poland, and Barex of Technoplast, a national enterprise of Czechoslovakia. These materials are produced from non-woven fibered mats, which are impregnated by a solution of a non-reactive polyurethane elastomer in tetrahydrofuran, dimethylsulfoxide, dimethylformamide, and the like. In the production of these materials, there are serious difficulties and technical problems connected with regenerating and recovery of the solvents used from admixture with water, and in maintaining healthful working conditions.

There have also been described technological processes for manufacturing artificial leathers based on the principle of coagulating solutions of substantially linear non-reactive polyurethane elastomers in dimethyl formamide with water and aqueous solvent systems (see, for instance, the process for manufacture of the artificial leather Corfam, described in Encyclopedia Polymer Science and Technology, 1964; or the process for the manufacture of the Czechoslovakian synthetic leather Barex). The last mentioned methods, although representing the most developed manufacturing systems so far known, are nevertheless very expensive; the main drawbacks are the high prices for the dimethylformamide solvent used, the complicated design of the equipment which is necessary to comply with the extreme requirements for the purity of the recirculated solvent after it has been separated from the water, just as well as the complex hygienic precautions which are to be met when using chemical substances of the dimethylformamide type.

Increasing the sorption ability of artificial leathers by applying impregnating systems comprising natural or synthetic polymers characterized by hydrophilic groups, such as carboxylic groups, is disclosed in U.S. Pat. Nos. 3,428,283 and 3,575,753, and in Federal German Republic published applications DOS 1,565,087, 1,811,593, 1,904,348, 1,951,977, and 2,043,452. However, these processes have not gone into commercial practice. The health problems in the production of artificial leathers from non-woven fibered materials are solved by the procedure in which the grain (face) layer of the artificial leather is provided on the fibered mat by spreading polyurethane elastomer onto the surface of the mat with a knife or a spatula. The characteristic feature of this processing is the use of nonreactive polyurethane elastomers, which contain practically no free isocyanate (-NCO) groups and thus there results a sheet material having a thermoplastic homogenous, nonpermeable surface layer.

A serious defect of all the heretofore produced artificial leathers for cases, upholstered articles and shoes is the local non-homogeneous ductility. This is especially pronounced at an elongation above 20–30 percent at the folds and corners of upholstered articles and on the toes of shoes, in practice this defect being called a "bumped", "non-homogeneous", or "orange-peel" surface. This property results from the scattering nonhomogeneity of the individual fibers in the volume of the non-woven fibered mat, this being considered in the direction, space-displacing, and mixing of the individual kinds of fibers, and thereby causing local nonhomogeneities in ductility and flexibility of the entire resulting sheet material. The influence of the nonhomogeneity of the non-woven fibered mat can be overcome by inserting one or more layers of a fabric (woven or knitted fabric of special properties) between the non-woven, impregnated mat and the facing microporous layer. The microporous face of such an artificial leather is then provided by coagulating a dimethyl formamide solution of the nonreactive polyurethane elastomer with water or by spraying of reactive mixture of polyurethane having a low content of free -NCO (isocyanate) groups in combination with a suitable hardening agent.

Substantially linear, non-cross-linked polyurethane elastomers are keeping constantly their plastic character and, when constantly held under stress, they may exhibit the phenomenon of plastic flow, the so-called "creep". In locations where great deformations occur, as on the toes of shoes or on the folds and corners of upholstered articles, as well as in areas of local inhomogeneities of the fibered substrate, the plastic surface layer of the artificial leather becomes weakened, as a result of which the above-mentioned defects of "bumps" and "orange peel" appear on the surface thereof.

It has now been found that the so-far achieved properties of artificial leathers may be substantially improved by coating a non-woven fibrous mat with a plurality of surface layers from a mixture of reactive polyurethane elastomers to form an artificial leather according to the present invention which is characterized in that the elasticity modulus $E_1$ of the layer adjacent to the fibrous substrate is lower than the elasticity modulus $E_2$, $E_3 \ldots E_{p-1}$ of any of the following layers and at the same time lower than the elasticity modulus $E_p$ of the uppermost surface layer according to the relation $$E_1<E_2<E_3<\ldots<E_{p-1}<E_p$$

while all values of the elasticity modulus E are in the range of from 12 to 170 MPa. The method of continuous manufacture of this artificial leather is characterized in that the reactive polyurethane prepolymer containing free isocyanate groups -NCO in the range of from 2.0 to 4.0 percent by weight in admixture with an amine hardening agent at molar ratio of -NCO groups to $-NH_2$ groups of from 1.0:1.0 to 5.0:1.0, preferably from 1.50:1 to 3.0:1, is coated onto the substrate or the preceding layer in an amount corresponding to a total thickness of 20 to 600 $g/m^2$ for individual layers up to a maximum thickness of the completed coating in the range of from 50 to 2000 $g/m^2$.

The formation of an adequate number of cross-links in the polyurethane elastomer layers results in branching and cross-linking of the overall structure of the polymeric material. This cross-linking and branching takes place no sooner than upon mixing both of the main reaction components together, that is, the polyurethane prepolymer with free -NCO groups and the amine hardening agent; throughout the entire processing period, both of these components are of a somewhat viscous character, so that no strong dilution with organic solvents is necessary.

The coating layers made from the reactive types of polyurethanes, that is, the prepolymers with terminating isocyanate -NCO groups, thus becomes analogous to vulcanized elastomers based on natural and synthetic butadiene rubbers, as fas as their structure is concerned. In these substances, the plastic flow and "creep" have practically been completely suppressed.

One would assume that the cross-linked coating layers, characterized by the aforementioned differences in elasticity modulus according to the present invention, exhibit a certain degree of prestressing under the conditions of constant stretch, the prestressing being directed toward the inside of the artificial leather layers. Here, the prestressing forces either transform the local inhomogeneities of the fibers into a rather more oriented state or press the fine and tiny differences in the substrate thickness towards the inside without doing any harm to the optical appearance of the surface coating whatsoever.

Because of this, it is desirable to orient the elasticity of the individual layers according to a certain rule, for which the following mathematical relation has been formulated:

$$E_1<E_2<E_3<\ldots<E_{p-1}<E_p.$$

The elasticity modulus E is derived from Hook's Law. There is reference to a practical application thereof to compressible materials in: J. F. Hutton, J. R. A. Pearson and K. Walters' "Theoretical Rheology", pages 123 through 137; and by Gianni Astarita and Guilio Cesare Sarti "Thermomechanics of Compressible Materials with Enthropic Elasticity", Applied Science Publishers, Ltd., London, 1975. The measuring unit for the elasticity modulus E, Pa (pascal), has been introduced by the ISO Standard 1000-1973 (f). In this standard, the unit is mentioned on page 3. The expression MPa holds for megapascal, M being a multiple of the basic unit and equalling $10^6$ Pa.

The elasticity modulus of the uppermost coating layer, $E_p$, has to be of a greater value, or more precisely, of the greatest value, which means that the material used for the outer layer must exhibit the relatively greatest resistance to becoming damaged under the forces of constant stretch.

Thus, it has been found, and this is one of the most important features of the present invention, that the individual coating layers of the polyurethane elastomer, which are characterized by having various porosities, varying degree of cross-linking or different contents of fillers or hardening agent, but above all with varyiing elasticities, providing an elastic bond between the fibrous substrate and the uppermost polyurethane layer.

Further advantages of the mentioned process are that the solvent requirements are substantially reduced and there is no need of inserting a fabric interlayer between the non-woven fibrous mat and the facing layer of the artificial leather; moreover, there are obtained better characteristics of elasticity; and the effect of the local non-homogeneous ductility is also eliminated. The invention also enables providing either a fine facing grain without creating the so-called "orange peel effect" or providing deep designs which cannot be obtained with a coating of one layer. Finally, a significant feature is the production of individual microporous layers, which constitute the facing layer of the artificial leather, by simultaneous spraying of mixtures containing the reactive polyurethane prepolymer and a hardening agent, thus enabling continuous processing at high productivity.

The artificial leather of the invention comprises a fibrous sheet material having on the surface thereof a coating formed of at least two layers of polyurethane elastomer with the elasticity modulus E of the layer of the polyurethane elastomer adjacent to the fibrous sheet being lower than the elasticity modulus $E_2$, $E_3 \ldots E_{p-1}$ of any of the following layer or layers, and at the same time being lower than the elasticity modulus $E_p$ of the finish layer according to the relation $$E_1<E_2<E_3<\ldots<E_{p-1}<E_p,$$

under the condition that all values of the elasticity modulus E are in the range of from 12 to 170 MPa. The method of manufacturing the artificial leather according to the invention is characterized in that the reactive polyurethane prepolymer, containing free isocyanate -NCO groups, preferably in the range of from 2.2 to 3.2 percent by weight, in admixture with an amine hardening agent at the molar ratio of -NCO groups to $-NH_2$ groups of from 1.0:1.0 to 5.0:1.0, preferably from 1.5 to 1.0 to 3.0:1.0, is coated on the fibrous sheet in an amount of 20 to 600 grams per square meter for individual layers, with the combined thickness of the coated layers being in the range from 50 to 2000 g/m$^2$.

Such artificial leather may be prepared in any of several ways. According to one procedure, the compositions of the prepolymer and amine are sequentially applied directly to the surface of the fibrous sheet material to form several layers, which are sequentially subjected to a temperature of 60° to 100° C. to complete the respective polymeric reactions and to effect drying thereof.

Alternatively, the prepolymer-amine compositions are sequentially applied to a strippable backing member to form several layers thereon, such layers except the last being sequentially subjected to a temperature of 60° to 100° C. Thus, the respective polymeric reactions are completed and drying of the layers is effected. The resulting assembly and the fibrous sheet material are then combined, with the last layer of the former in contact with a surface of the latter; and the same is subjected to a temperature of 60° to 100° C. to complete the final polymeric reaction and drying.

Optimally, the production of the present artificial leather is carried out on a continuous basis.

A non-woven fibrous mat or sheet material suitable for the present purpose is made from a mixture of synthetic fibers of various elastic stretch properties and thermal shrinkage ability or from a mixture of natural and synthetic fibers of similar properties. Especially useful are mixtures of polyethylene terephthalate and polypropylene staple fibers, mixtures of polyamide and polypropylene staple fibers, and mixtures of collagenous fibrous material and polyester fibers or staple fibers, all at a ratio of 10:90 to 80:20 parts by weight, and also multicomponent mixtures containing cellulose fibers, collagenous fibrous material, and polypropylene or polyester or polyamide staple fibers ranging from 10 to 90% by weight. The indicated fiber mixtures are subjected to known fabric processing operations including mixing of the respective kinds of staples and fibers, fleecing and felting of similar layers, and compacting of fleece by needle machines until a non-woven fibrous web is obtained having the specific weight in the range of from 0.15 to 0.30 g/cm$^3$. The density required differs from the application of the artificial leather; it has been found experimentally that the optimum value for children and ladies shoes equals around to 0.20 g/cm$^3$, while for men's shoes the optimum value equals around to 0.25 g/cm$^3$. The thickness of the non-woven fibrous web equals conventionally to 0.8 to 5.0 mm; this being in no case a critical property in view of the fact that after the impregnating process of the non-woven fibrous web has been terminated it is an advantageous operation to reduce the thickness thereof by splitting or by buffing to the desired value The resulting non-woven fibrous web is then impregnated with an aqueous dispersion of an elastomer, or an aqueous dispersion of a thermosensitive or thermoreactive butadiene-acrylonitrile, butadiene-styrene or carboxylated butadiene-acrylonitrile copolymer.

In order to prepare a fibrous web with satisfying water vapor permeability and ability of absorbing and desorbing moisture, it is necessary to prepare a composite elastomeric system, i.e. to combine the abovementioned elastomers with hydrophylic copolymers, which have been prepared on the basic of unsaturated organic acids, especially of polyhydric organic acids.

Among these, most suitable are the copolymers of maleic acid anhydride, maleic acid and salts of this acid, further the copolymers of derivatives of fumaric acid, itaconic acid, citraconic acid, etc. with styrene, ethylene, vinyl acetate, vinyl chloride, and acrylates, containing from 5 to 50 molar percent of an unsaturated acid.

Alternatively, also other combinations of hydrophylic copolymers may be used, which comprise vinyl alcohol, hydroxy ethyl, carboxyl, carbonyl and sulpho groups.

Generally, the amount of the composite elastomeric mixture, as related to the weight of the non-woven fibrous web, is from 30 to 60 percent by weight, while the content of the hydrophylic copolymers equals from 2 to 30 percent by weight of the dry matter of this composite.

The polyurethane elastomer utilized in carrying out the invention is desirably the polymeric material resulting from the reaction of a diol or triol having a molecular weight of 40 to 4000 and an aromatic substituted diisocyanate, with the molar ratio of the functional hydroxyl groups to the isocyanate groups being 1.05:1.00 to 0.8:1.2, and with the addition of a small quantity of an amine in the equivalent ratio of amine groups to isocyanate groups of 1.0:1.0 to 1.0:5.0. The chemical structure of the resulting polyurethane macromolecules is characterized by urethane (-O-CO-NH-) and urea (-NH-CO-NH-) bonds; and the resulting prepolymer products ae characterized by a molecular weight of at least 2000. Those polymeric substances containing free isocyanate groups in the range of 2.0 to 4.0% by weight are reactive polyurethane prepolymers.

The present prepolymer mixtures also contain an amine, which serves to increase the molecular weight and to cross-link the product, and acts as a hardening agent. Generally, the reactive polyurethane prepolymer and the hardening agent are admixed at a molar ratio of free isocyanate groups to the amine groups of 1.0:1.0 to 5.0:1.0.

It is an advantage in many instances for the reactive polyurethane prepolymer to include hydrophilic segments of polymeric ethylene oxide derivatives. For this purpose, poly(ethylene oxide) or poly(propylene oxide) having molecular weights of 400 to 400,000 are particularly suitable.

The hydrophylic segmented polyether urethane according to this definition therefore comprises chain blocks according to the general formula:

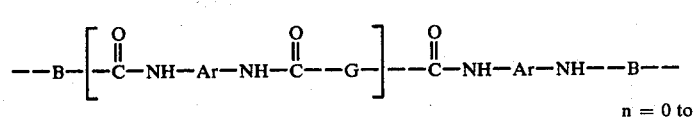

(X)

n = 0 to 5 where the "soft segment" B is represented with polyether sequentials:

$$B = -[-(-D-CH_2-CH_2-)_x-O-]-;\ x = 10 \text{ to } 10000 \qquad (XI)$$

$$\text{or} \ldots -\left[-(-O-\underset{\substack{|\\ CH_3}}{CH}-CH_2-)_y-O-\right]- \ldots;\ y = 8 \text{ to } 8000 \qquad (XII)$$

$$\text{or} \ldots -\left[-(-O-CH_2-CH_2-)_w-(-O-\underset{\substack{|\\ CH_3}}{CH}-CH_2-)_z-(-O-CH_2-CH_2-)_w-O-\right]- \ldots; \qquad (XIII)$$

w = 1 to 1000,
z = 8 to 8000

Further the "hard segments" have been synthetised on the basis of di- and trivalent groups G, e.g.:

$$G = \ldots -O-CH_2-CH_2-O- \ldots;$$
$$\ldots -O-\underset{\substack{|\\ CH_3}}{CH}-CH_2-O- \ldots;$$
$$\ldots -O-(CH_2)_4-O- \ldots;$$
$$\ldots -O-CH_2-\underset{\substack{|\\ OH}}{CH}-CH_2-O- \ldots;$$
$$\ldots -O-CH_2-\underset{\substack{|\\ O-CO-R}}{CH}-CH_2-O- \ldots \text{ etc.}$$

in combination with the rest of an aromatic diisocyanate . . . -CO-NH-Ar-NH-CO- . . ., where the aromatic system -Ar- may comprise phenylene, tolylene, xylylene, diphenylurethane, di-(alkylphenyl)-)metane, diphenylpropane, diphenyl, naphthlene, etc. groups; in a specific case a heterocyclic compound may also be used, such as for instance the rest of

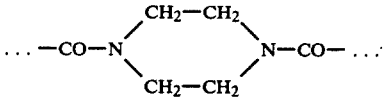

Practical examples of polyurethanes of these types are out of the polymers produced in the United States for instance "Spandex" (product of E. I. Du Pont de Nemours and Company), Estane 5710-F1" or Estane 5707-F1 (product of B. E. Goodrich Chemical Co.).

The essence of the present invention lies in forming at least two microporous layers of the above-mentioned polyurethane elastomers on the fibrous mat. In addition, the variation of the elasticity, the degree of cross-linking or porosity in the individual layers provides for ideal scattering of the various components of the forces induced during long-term slow bending or under repeated fast bending or flexing of the artificial leather in production and in use.

Formation of the layers of the polyurethane elastomer may be readily accomplished, for example, by mixing of the reactive polyurethane prepolymer with the hardening agent in a through-flow mixer at a temperature of 20° to 90° C. during an average residence time of up to 2 minutes. In the mixer, the polymeric reactions are initiated, including cross-linking of the developing polyurethane elastomer.

Within a short time, in the range of 1 second to 2 minutes, after both components are mixed, the reacting mixture should be uniformly applied to the desired surface. It is suitable to carry out this operation on continuous apparatus which enables spraying or coating (glazing) of the reactive mixture onto the surface, as in the direct application of the reactive polyurethane mixture onto the fibrous mat as described above.

In the carrying out of the above-indicated alternative procedure, it utilizes a strippable or releasing backing member provided with a desired design imprint so that the resulting layer assembly with its formed design can be then adhered to the fibrous mat. Such backing member may be made of any suitable material including paper, silicone rubber, polyolefins, epoxy resins, adhesive plaster, Wood's alloy, type metal and steel.

The thickness of the individual polyurethane elastomer layers can be readily determined on the basis of the respective surface mass. It is desirably equivalent to 20 to 600 g/m$^2$ for each layer; for the whole multilayer microporous sheet, the thickness is desirably equivalent to 50 to 2000 g/m$^2$. Optimally, the multilayer coating has a thickness equivalent to 200 to 600 g/m$^2$.

Variation of the elasticity and the degree of cross-linking of the individual layers is achieved by changing the composition of the mixture which contains the reactive polyurethane prepolymer and/or the mixture containing the hardening agent. The basic factors include:

The change of the chemical structure of the hardening agent by the use of different amines, including for example, hydrazine, ethylene diamine, hexamethylene diamine, triethyl amine, benzidine, methylene-bis(ortho-chloraniline), and various polyamides.

When using for instance the segmented polyether urethane based on the polypropylene glycol containing 2.5 percent by weight of free -NCO groups (see Prepolymer II. In Example 1), it is possible to achieve, when hydrazine (Hardening agent III) in used, the elasticity modulus $E_p$ of about 100 MPa.

The same Prepolymer II, when used for cross-linking with methylene-bis(ortho-chloraniline) MOCA, forms a layer with an elasticity modulus Ep-1 of about 85 to 90 MPa.

An aliphatic diamine, such as for instance hexamethylene diamine (hardening agent II), when combinated with the same prepolymer II, forms a polyurethane of elasticity modulus Ep-2 of about 66 to 75 MPa.

The change of the molar ratio of the free -NCO groups of the prepolymer to the amine groups of the hardening agent especially within the indicated range of 1.0:1.0 to 5.0:1.0.

When cross-linking for instance the Prepolymer IV containing 3.2 percent by weight of free isocyanate groups with a hardening agent (Hardening agent V), the following results have been achieved:

| Molar ratio —NCO/—NH$_2$ | Elasticiti modulus |
|---|---|
| 1.05 | 160 to 185 MPa |
| 2.52 | 105 to 130 MPa |

-continued

| Molar ratio —NCO/—$NH_2$ | Elasticiti modulus |
|---|---|
| 2.85 | 85 to 105 MPa |
| 3.00 | 42 to 60 MPa |
| 5.00 | 30 to 45 MPa |

The function of the added diluents is the forming of the coating, is not only in maintaining a suitable prepolymer viscosity but also in forming the desired degree of porosity by vigorous evaporation especially during final drying of the gel-like cross-linked sheet material.

After the chemical reaction with the hardening agent, the cross-linked layers of polyurethanes are unsoluble in conventional organic solvents. Depending upon the density of intermolecular bonds, they may swell, though, more or less (for instance in acetone), this is a feature use of which may be made for measuring of the cross-linking and the porosity degree.

Thus for instance when mixing Prepolymer I with Hardening agent I, one may obtain at a varying content of the 1.1.2-trichloro- 1.1.2-trifluoro ethane (Freon 113):

| Freon 113 content g/g of mixture | Density of the polyuretane layer g/cm$^3$ | Apparent elasticity modulus MPa |
|---|---|---|
| 0/500 | 0.988 | 105 to 110 |
| 15/500 | 0.902 | 80 to 90 |
| 30/500 | 0.800 | 55 to 65 |
| 50/500 | 0.500 | 25 to 45 |

It has been observed that fillers and/or dyestuffs that may be present may have some effect in the formation of the layer structure on the physical and mechanical properties of individual polyurethane layers. For example, inorganic pigments such as oxides, sulphides and complex hydroxides may influence the chemical reactivity of the polyurethane prepolymer by their residual content of sorbed and bound moisture. There may also be a physical effect of the stiffening of the polyurethane mixtures caused by adhesion interaction, especially with highly dispersible inorganic fillers and pigments. The active organic dyestuffs are characterized by generally reactive groups such as $-NH_2$, $-OH$, $-SO_3H$, and $-COOH$, whereby this added dyestuff may be incorporated into the macromolecular chain during the elastomer cross-linking action. The dispersing agents included in commercial pigments and dyestuffs, especially casein, starch, polyvinyl alcohol and other polymers and copolymers, also contain reactive amino and hydroxyl groups. During interaction of dyestuffs containing such dispersing agents, these polymeric substances may also be incorporated into the polyurethane skeleton.

The present invention also enables substantial savings in operation and investment costs such as by reduction in the amount of solvent used. Other factors involve lower toxicity of the used solvents as well as limiting undesirable atmospheric discharges and controlling the quantity of waste waters.

EXAMPLE 1

A fibrous web for making artificial leather is made of a mixture by weight of 40% polyamide fibers 1.6/40 staple/denier, 35% high-shrinkable polyester fibers 1.2/60, and 25% cellulosic staple 1.7/40. The prepared web is soaked in a mixture containing 70 parts of a carboxylated butadieneacrylonitrile latex (content of acrylonitrile 42 percent by weight, —COOH 5 percent by weight; dry matter 41 percent by weight) 32 parts of butadiene-styrene elastomer latex (36 percent by weight of styrene; dry matter content 38 percent by weight), and 6 parts by weight of an aqueous ammonium salt of the alternating copolymer of ethylene-maleic acid (pH of that solution was 9.2; dry matter content 50 percent by weight).

The impregnated fibrous mat in the final dry stage contains 65% of the mentioned polymeric materials (in the form of total solids, calculated on the initial weight of the fibrous web). The mat is then exposed to the treating operation necessary to provide a suitable flat surface such as splitting and grinding.

The first layer on such a prepared fibrous mat is produced by continuous glazing from a flat nozzle which is directly connected to the mixer of the prepolymer and the hardening agent. The average residence period of the reacting polymeric mixture in the mixer and the nozzle should not be longer than about 45 seconds, with the temperature kept under 50° C. The amount of both reacting components is controlled by volume pumps. The following values are in grams per 1 m$^2$ of the surface of the fibrous mat (in this and all following examples):

| | |
|---|---|
| Prepolymer I: | |
| polycondensate of ethylene glycol with adipic acid and with diphenyl methane diisocyanate, containing 2.2% of free —NCO groups (Adiprene L 100 of E.I. DuPont de Nemours & Co., U.S.A.) | 350 g. |
| toluene | 50 g. |
| diluent 1,1,2-trichloro-1,2,2-trifluoro ethane (Freon 113) | 30 g. |
| Hardening agent I: | |
| methylene-bis-/ortho-chloroaniline/(MOCA of E.I. DuPont de Nemours & Co., U.S.A.) | 15 g. |
| methyl ethyl ketone | 52 g. |
| micronized ferrite pigment (ocher) | 2.1 g. |
| grease (silicone oil) | 0.5 g. |

The fibrous mat with the layer made of the amine hardening agent and of the reacting polyurethane of the ratio of -$NH_2$:-NCO groups 1.0:3.2 enters a drying tunnel which is heated to a temperature of 80°-100° C. with a belt movement of 1.8 m/min.

The elasticity modulus upon flexing of the reacted polyurethane mixture is 55 to 65 MPa. (The values are found by measuring the reacted polyurethane mixture separately outside the processing equipment.)

Immediately after the coated mat leaves the tunnel, the next layer can be deposited. Such layer is made by using a pressure-mixing spraying gun in which mixing of both components is performed and little drops of the reacting polyurethane prepolymer are uniformly dispersed over the whole surface of the fibrous sheet. The average residence time of the mixture in the spraying apparatus is less than 3 seconds, at a temperature under 100° C. The formulation of the prepolymer and amine hardener of the second layer is also defined in grams per square meter of the artificial leather, the molar ratio of -$NH_2$:-NCO groups being 1.0:3.3.

| |
|---|
| Prepolymer II: |
| polycondensate of poly/propylene glycol/ having an average degree of polymerization of 17 and diphenyl methane diisocyanate, the content of free —NCO groups being about 2.5% (the poly- |

-continued

| | |
|---|---|
| propylene glycol was obtained from the firm CHZWP in Novaky, Czechoslovakia) | 150 g. |
| methyl ethyl ketone | 50 g. |
| Hardening agent II: | |
| hexamethylene diamine("Epicure 2" of Shell Chemical Co.) | 1.6 g. |
| methyl ethyl ketone | 35 g. |
| chrome yellow | 5 g. |
| chrome phthalate brown | 5 g. |
| grease (silicone oil) | 1 g. |

The conditions under which the reaction took place in the tunnel dryer are the same as those mentioned in the first coating operation. The elasticity modulus, determined after 24 hours separately outside of the operation equipment on a sample of reacted polyurethane mixture, was in the range of from 66 to 75 MPa.

The third layer is produced in a similar way to the second one, that is, by spraying it on with a pressure mixing gun. The formulation of the prepolymer is basically the same as the prepolymer II, the composition of the hardening mixture having been changed as follows:

| Hardening agent III: | |
|---|---|
| hydrazine | 0.6 g. |
| methyl ethyl ketone | 40 g. |
| chrome yellow | 3 g. |
| chrome phthalate brown | 10 g. |
| fluorescence red dyestuff | 0.3 g. |
| grease (silicone oil) | 1.5 g. |

Passage through the tunnel dryer at a temperature of 50° to 100° C. is carried out in such a way that the residence time of the resulting artificial leather sheet is 8 to 10 minutes. The elasticity modulus of this third layer is more than 100 MPa.

The sheet material leaves the dryer and, if any special finishing treating is desired, passes to the requisite design-imparting apparatus and then to the cooling cylinders. In the final phase, the sheet material is baled for storage, transport and further manipulation. The produced artificial leather shows optimum physical and mechanical properties only after the chemical reaction and crystallization processes are completed, that is, after 1 to 10 days. Its properties are summarized in the following table:

| Property | Measuring unit | Values |
|---|---|---|
| Tensile strength | $kg/cm^2$ | |
| A | | 102 |
| B | | 96 |
| Elongation | % | |
| A | | 63 |
| B | | 65 |
| Water vapor permeability | $mg/cm^2/hr$ | 1.5 |
| Absorption capacity | $mg/cm^2$ | 18 |
| Desication | % | 83 |
| Thickness | mm | 1.53 |
| Square mass | $g/m^2$ | 910 |
| Volume mass | $g/cm^3$ | 0,85 |
| Bally flexibility after 200 kc | | 4 |

EXAMPLE 2

The production of the polyurethane coating is done in a reversible manner by spraying of the individual layers onto a backing of a siliconized paper provided with a suitable design which is passed through a continuous spraying apparatus. The facing finish is first produced by spraying the mixture:

| | |
|---|---|
| polyuretane prepolymer (prepared from tolylene diisocyanate and glycol, which corresponds with the formula X on page 18; average molecular weight of about 2000 to 2200, content of the free —HCO groups 4 per cent) | 9.1g |
| nitrocellulose | 5.5g |
| dispersed $SiO_2$ (Aerosil-siloxane wetting agent) | 4.0g |
| mixture of solvents (acetone, methyl ethyl ketone, butyl acetate, toluene 1:1:1:2) | 60.0g |

The elasticity modulus Ep for this layer has a value in the range of from 140 to 165 MPa, this being due to the segmented chemical structure of the prepolymer and due to the interaction of the free -NCO groups with the dispersed $SiO_2$.

The thickness of the finish equals to about 20 to 35 grams per square meter. The high degree of cross-linking and/or low microporosity of this reaction product, was characterised by a low swelling in acetone-only about 55 mg of acetone per one gram at 20° C. in 24 hours. (The measurement performed on a separately prepared sample.

Immediately after partial drying of the finish layer, spraying of the next layer of polyurethane elastomer is performed, this being done on a spraying apparatus analogous to that of Example 1:

| | |
|---|---|
| Prepolymer IV: | |
| polyurethane/content of free —NCO groups 3.2% (Baycastadduct LPU of Farbenfabrik Bayer A.G., West Germany) | 150 g. |
| Hardening agent IV: | |
| amino-compound (polyamine - Baycast Harter HTA, Bayer A.G.) | 6.1 g. |
| methyl ethyl ketone | 28.0 g. |
| silicone grease | 1.0 g. |
| dispersed dyestuff (prepared from 2,4g. of composite inorganic pigment $TiO_2$ $Fe_2O_3$, further 0.8g mixture of pigment red 49 + versale green GN, creating the desired brown shade, and 3.0g. of the low molecular polypropylene diol of average molecular weight of about 3000) | 6.2 g. |

The elasticity modulus $E_{p\text{-}1}$ for this layer is in the range of from 80 to 120 MPa. The ratio of $-NH_2$ to -NCO groups, derived from the structure of compounds used, equals 1.0:1.50. The degree of cross-linking and/or microporosity determined by swelling of a separately prepared sample in acetone at 20° C., 20 hours, was 150 to 180 mg/g. The thickness from 300 to 325 $g/m^2$.

The paper backing with the deposited layers passes through a tunnel dryer at a temperature of 55° to 75° C. and a residence time of 4 to 5 minutes and, immediately after leaving the dryer, is provided with a supporting microporous polyurethane urethane layer, which is also deposited by spraying from the pressure-mixing gun as stated in Example 1.

| |
|---|
| Prepolymer V: |

-continued

| | |
|---|---|
| reactive polyurethane (prepolymer II) | 100 g. |
| reactive polyurethane (prepolymer IV) | 100 g. |
| toluene | 50 g. |
| Hardening agent V: | |
| mixture containing 5.5 g. polyamine HTA and 1.3 g. benzidine | 6.8 g. |
| water | 2.5 g. |
| organic dyestuff (the same as in the Hardening agent IV) | 1.90 g. |
| silcone grease | 0.15 g. |

The elasticity modulus $E_1$ for this layer is in the range of from 55 to 79 MPa, with the initial ratio of reactive groups NCO to $-NH_2$ groups being approximately 1.74:1.0. The thickness of that layer was 325 to 350 $g/m^3$ and swelling in acetone was about 300 mg/g.

In an interval which does not exceed 80 seconds from the moment of mixing of both components, the fibrous mat is pressed onto the sticky back-side of the last layer, and the thus-formed sheet is passed through a tunnel dryer at a temperature of 60° to 80° C. for 4 to 7 minutes. The composite is cooled by guiding metal cylinders after leaving the dryer and then is wound onto transportable reels.

The fibrous mat was prepared by impregnating a web from a mixture of 30% thermally shrinkable polypropylene fibers 1.4/60, 25% thermally shrinkable polyester fibers 1.2/60 and 40% polyamide fibers 1.5/40. A suitable dispersion for the impregnation comprises a mixture of carboxylated butadieneacrylonitrile elastomer, a thermosensitive latex (such as butadiene-styrene), and an aqueous solution of an ammonium salt of an ethylene-maleic acid copolymer. The properties of the produced artificial leather are summarized in the appended table. The produced material exhibits no "orange peel" effect when stretched from 20 to 40 percent, not only longitudinally, but also when stretched in a bent state over a cylindrical pin. The surface finish and the pattern under these conditions of stretching full satisfy the requirements for upper parts of shoes and for production of heavy, exposed upholstery articals.

EXAMPLE 3

Artificial leather is produced by the reversible method as described in Example 2. The differences relate to the compositions of the reactive mixtures and the scheduling of the continuous belt for the spraying mixture and the time of the chemical reaction:

| | |
|---|---|
| Prepolymer VI: | |
| reactive polyester-urethane with content of 2.9% free —NCO groups (Baycastadduct LPU) | 235 g. |
| Hardening agent VI: | |
| polyamine (Baycast Harter HTA, Bayer A.G., West Germany) | 9.6 g. |
| methyl ethyl ketone | 46.0 g. |
| dispersed dyestuff containing inorganic pigments on the basis of $Fe_2O_3$ | 10.0 g. |
| other agents (grease, catalyst, organic dyestuffs) | 1.85 g. |
| Further details concerning these other agents, including the amounts of each, are as follows: | |

-continued

| | |
|---|---|
| silicone oil | 0.35 g. |
| organic dyestuff pigment red 52 | 0.25 g. |
| catalyst (Bayer A.G. of West Germany) of unknown chemical composition | 0.25 g. |
| dispersing agent, a polyol on the basis of polypropylene oxide | 4.00 g. |

The temperatures in the individual sections of the tunnel dryer fall from 85° C. at the beginning to 60° C. at the end. The residence time therein is 4 minutes. The elasticity modulus $E_P$ was 100 to 125 MPa. The molar ratio of amine to isocyanate groups was 1.0:2.5, the thickness of that layer was 150 $g/m^2$ and the porosity (or in other words the degree of cross-linking) as defined by the method of swelling in acetone at 20° C., 24 hours, was about 100 mg/g.

| | |
|---|---|
| Prepolymer VII: | |
| reactive polyurethane containing 2.95% of free isocyanate groups (Baycastadduct LPU) | 250 g. |
| Hardening agent VII: | |
| polyamine (Baycast Harter HTA of Bayer A.G., W. Germany) | 5.5 g. |
| methyl ethyl ketone | 10.0 g. |
| toluene | 10.0 g. |
| carbon tetrachloride | 37.0 g. |
| pigment green (yellow dyestuff) | 0.18 g. |
| catalyst of unknown chemical composition (product of Bayer A.G., G., West Germany) | 0.70 g. |
| silicone grease | 1.00 g. |

The elasticity modulus $E_1$ was 75 to 95 MPa. The molar ratio of amine groups to isocyanate groups was 1.0:2.75, which resulted in combination with the greater microporosity (due to $CCl_4$) content to a lower apparent elasticity modulus Ep-1 in the range of from 75 to 95 MPa and to higher swelling in acetone to about from 400 to 500 mg/g (at 20° C., 24 hours). The thickness of the polyurethane tayer formed was from 300 to 350 $g/m^2$.

Immediately after creating the multilayer polyurethane sheet, it is pressed onto the parallel moving fibrous mat. The latter was prepared from a mixture of 25% polypropylene staple 1.2/60, 20% polyester staple 1.4/40, and 55% chrometanned collagenous pulp; the impregnating mixture consisted of carboxylated butadiene-acrylonitrile latex XNBR, a thermosensitive butadiene-acrylonitrile latex, a dispersion of an acrylate copolymer, and an aqueous solution of an ammonium salt of a styrene-maleic acid copolymer. Passage through a continuous tunnel dryer takes place over 2.5 to 3 minutes at a temperature of 60° to 80° C. The product, after being cooled on metal cylinders, is stripped from the continuous belt and gathered in the form of bales. The material reaches its optimum strength and elasticity characteristics only after a certain time of storage, in the present instance after 8 to 10 days. The properties are shown in the following table. For the purpose of comparison, there are also given the published values for box sides (natural leather) and a commercially available artificial leather.

| Property | Measuring unit | Method of measuring | Examples according to the invention 1 | 2 | 3 | Box Sides | Commercially available artificial leather |
|---|---|---|---|---|---|---|---|
| tensile strength | $kg/cm^2$ | | 1 | 2 | 3 | | |
| A | | CSN | 102 | 92 | 105 | 320 | 125 |

-continued

| Property | Measuring unit | Method of measuring | Examples according to the invention 1 | 2 | 3 | Box Sides | Commercially available artificial leather |
|---|---|---|---|---|---|---|---|
| B | | | 96 | 93 | 100 | | 117 |
| Elongation | % | | | | | | |
| A | | CSN | 63 | 66 | 65 | 70 | |
| B | | | 65 | 64 | 70 | | 80 |
| water vapor permeability | $mg/cm^2/hr$ | | 1.5 | 2.1 | 1.6 | 2.0–4.5 | 2.5 |
| absorption capacity | $mg/cm^2$ | | 18 | 17 | 10 | 26–42 | 4 |
| dessication | % | | 83 | 85 | 90 | 80–90 | 90 |
| thickness | mm | — | 1.53 | 1.4 | 1.5 | 1.5 | 1.5 |
| square mass | $g/m^2$ | — | 910 | 800 | 920 | 1,500 | 745 |
| volume mass | $g/cm^3$ | — | 0.85 | 0.57 | 0.6 | 0.85 | 0.52 |
| bally flexibility after 200 kc | | | 4 | 4 | 4 | 5 | 5–4 |
| stretching inhomogeneity test (at 20% elongation) | | direct stretch | good | good | good | good | unsatisfying |
| | | bend stretch | satisfying | good | good | good | unsatisfying |

It will be obvious from the foregoing that the advantages and objects enumerated earlier have been attained. Various changes and modifications have been disclosed and others will be obvious to those skilled in the art. Therefore, this disclosure is to be taken as illustrative only and not as limiting of the scope of the claims.

What is claimed is:

1. Artificial leather comprising fibrous sheet material provided on a surface thereof with a coating formed of at least two discrete continuous layers of polyurethane elastomer, the layers of coating successively increasing from the fibrous sheet material to the uppermost coating in their respective elasticity modulus E such that the elasticity modulus $E_1$ of the layer adjacent to the fibered sheet material is lower than the elasticity modulus $E_2$, $E_3 \ldots E_{p-1}$ of any of the following layer or layers, and at the same time lower than the elasticity modulus $E_p$ of the uppermost finish coating layer according to the relation $$E_1 < E_2 < E_3 < \ldots < E_{p-1} < E_p,$$

the values of the elasticity modulus $E_1$-$E_p$ being in the range of from 12 to 170 MPa.

2. Artificial leather according to claim 1, in which each layer comprises a reaction product of (1) a reactive polyurethane elastomer prepolymer having 2.0 to 4.0% by weight of free isocyanate groups and (2) an amine, the molar ratio of free isocyanate groups to amine groups being 1.0:1.0 to 5.0:1.0, and in which the thickness of each layer is equivalent to 20 to 600 $g/m^2$, with the combined thickness of all of the layers being equivalent to 50 to 2000 $g/m^2$.

3. The artificial leather according to claim 2, in which the prepolymer has a molecular weight of at least 2000.

4. The artificial leather according to claim 2, in which the prepolymer includes hydrophilic segments of polyethylene oxide or polypropylene oxide having a molecular weight of 400 to 400,000.

* * * * *